US008325943B2

(12) United States Patent
Button et al.

(10) Patent No.: US 8,325,943 B2
(45) Date of Patent: Dec. 4, 2012

(54) DUAL-COIL, DUAL GAP ELECTROMAGNETIC TRANSDUCER WITH MULTIPLE CHANNEL AMPLIFIERS

(75) Inventors: Douglas J. Button, Simi Valley, CA (US); Bernard M. Werner, Los Angeles, CA (US); Ernest Bird, Osceola, IN (US); Alexander Victor Salvatti, Canoga Park, CA (US); Jerry Moro, Moorpark, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1223 days.

(21) Appl. No.: 11/623,261

(22) Filed: Jan. 15, 2007

(65) Prior Publication Data

US 2008/0170744 A1 Jul. 17, 2008

(51) Int. Cl.
*H04R 3/00* (2006.01)

(52) U.S. Cl. ..... 381/117; 381/120; 381/401; 381/421

(58) Field of Classification Search ..... 381/117, 381/396, 120, 28, 401, 406, 400, 412, 421, 381/420, 402, 335, 336, 332, 87, 342, 340, 381/339, 337, 413, 111; 310/12.24, 12.01
See application file for complete search history.

(56) References Cited

U.S. PATENT DOCUMENTS

| | | | | |
|---|---|---|---|---|
| 4,860,370 | A * | 8/1989 | Grosbard | 381/403 |
| 5,856,759 | A * | 1/1999 | Krochmal | 330/124 R |
| 2002/0097086 | A1 * | 7/2002 | Huijser | 330/69 |

* cited by examiner

*Primary Examiner* — Xu Mei
*Assistant Examiner* — Con P Tran
(74) *Attorney, Agent, or Firm* — The Eclipse Group LLP

(57) ABSTRACT

A dual-coil, dual magnetic gap electromagnetic transducer is provided where each voice coil is wired to include separate leads so that each individual voice coil may be driven by a separate amplifier or by a separate bridged amplifier. Signal processing may further be utilized to increase the output of the loudspeaker, to achieve extreme excursion without extreme distortion and to provide for alternative voice coil designs to address common problems with dual-coil, dual magnetic gap transducers, including, but not limited to, heat generation.

23 Claims, 16 Drawing Sheets

DUAL-COIL, DUAL GAP ELECTROMAGNETIC TRANSDUCER WITH MULTIPLE CHANNEL AMPLIFIERS

BACKGROUND OF THE INVENTION

1. Field of the Invention

This invention relates generally to electromagnetic transducers of the that may be employed as electro-acoustical drivers for loudspeakers. More particularly, the invention relates to electromagnetic transducers and loudspeakers having at least two coils capable of being driven by at least a two channel amplifier.

2. Related Art

An electro-acoustical transducer may be utilized as a loudspeaker or as a component in a loudspeaker system to transform electrical signals into acoustical signals. The basic designs and components of various types of electro-acoustical transducers are well-known and therefore need not be described in detail. An electro-acoustical transducer typically includes mechanical, electromechanical, and magnetic elements to effect the conversion of an electrical input into an acoustical output. For example, the transducer typically includes a magnetic assembly, a voice coil, and a diaphragm. The magnetic assembly and voice coil cooperatively function as an electromagnetic transducer (also referred to as a driver or motor). The magnetic assembly typically includes a magnet (typically a permanent magnet) and associated ferromagnetic components—such as pole pieces, plates, rings, and the like—arranged with cylindrical or annular symmetry about a central axis. By this configuration, the magnetic assembly establishes a magnetic circuit in which most of the magnetic flux is directed into an annular (circular or ring-shaped) air gap (or "magnetic gap"), with the lines of magnetic flux having a significant radial component relative to the axis of symmetry. The voice coil typically is formed by an electrically conductive wire cylindrically wound for a number of turns around a coil former. The coil former and the attached voice coil are inserted into the air gap of the magnetic assembly such that the voice coil is exposed to the static (fixed-polarity) magnetic field established by the magnetic assembly. The voice coil may be connected to an audio amplifier or other source of electrical signals that are to be converted into sound waves. The diaphragm includes a flexible or compliant material that is responsive to a vibrational input. The diaphragm is suspended by one or more supporting elements of the loudspeaker (e.g., a surround, spider, or the like) such that the flexible portion of the diaphragm is permitted to move. The diaphragm is mechanically referenced to the voice coil, typically by being connected directly to the coil former on which the voice coil is supported.

In operation, electrical signals are transmitted as an alternating current (AC) through the voice coil in a direction substantially perpendicular to the direction of the lines of magnetic flux produced by the magnet. The alternating current produces a dynamic magnetic field, the polarity of which flips in accordance with the alternating waveform of the signals fed through the voice coil. Due to the Lorenz force acting on the coil material positioned in the permanent magnetic field, the alternating current corresponding to electrical signals conveying audio signals actuates the voice coil to reciprocate back and forth in the air gap and, correspondingly, move the diaphragm to which the coil (or coil former) is attached. Accordingly, the reciprocating voice coil actuates the diaphragm to likewise reciprocate and, consequently, produce acoustic signals that propagate as sound waves trough a suitable fluid medium such as air. Pressure differences in the fluid medium associated with these waves are interpreted by a listener as sound. The sound waves may be characterized by their instantaneous spectrum and level, and are a function of the characteristics of the electrical signals supplied to the voice coil.

The energy transmitted by a speaker to sound waves is a function of the amount of movement of the diaphragm. The movement of the diaphragm is a function of the frequency of sound being transmitted (how frequently the diaphragm changes directions of movement) and the electrical voltage applied to the coil. The range of movement of the diaphragm is a function of the axial movement of the voice coil. This axial movement is often called the excursion.

For a loudspeaker to provide high output or deep bass, the loudspeaker may need a substantial excursion of the voice coil. In this context, an excursion is an axial movement of the voice coil from the position it assumes without electrical stimulus. Voice coils undergo excursions both towards and away from the diaphragm as the alternating electric current in the voice coil interacts with the magnetic field.

Due to advantages such as lighter weight and higher power handling, dual-coil/dual magnetic gap designs have been supplanting single-coil designs in loudspeakers. Many dual-coil/dual-gap designs are able to produce more power output per transducer mass and dissipate more heat than conventional single-coil designs. In a dual-coil driver, the voice coil includes two separate windings axially spaced from each other to form two coils, although the same wire may be employed to form both coils. In general, the magnet assembly of a dual-coil driver includes a stacked arrangement in which a magnet is axially interposed between a front pole piece and a rear pole piece. An outer ring is annularly disposed about the stacked arrangement such that all annular magnetic gap is defined between the outer ring and the stacked arrangement. The two coils are wound around a coil former and inserted into the gap such that one coil is located between the front pole piece and the outer ring and the other coil is located between the rear pole piece and the outer ring, in effect providing two magnetic gaps axially spaced from each other. As both coils provide forces for driving the diaphragm, the power output of the loudspeaker may be increased without significantly increasing size and mass.

The dual-coil configuration provides more coil surface area as compared with many single-coil configurations, and thus ostensibly is capable of dissipating a greater amount of heat at a greater rate of heat transfer. For example, a dual-coil design that doubles the surface area and number of turns of the coil winding may increase (e.g., nearly double) the capacity of the coil to dissipate heat. However, insofar as a desired advantage of the dual-coil driver is its ability to operate at a greater power output, so operating the dual-coil driver at the higher power output concomitantly causes the dual-coil driver to generate more heat. Hence, the improved heat dissipation inherent in the dual-coil design may be offset by the greater generation of heat.

In typical dual-coil dual gap driver, both voice coils are wired either in series or in parallel and attached to one amplifier channel. To achieve maximum power, it is also common to bridge the one amplifier channel with a second amplifier to supply the greatest voltage swing to a driver. In a powered speaker, the amplifier is built into the loudspeaker and the determination of whether to wire the voice coils in series or in parallel is predetermined. In other design, where an external amplifier must be utilized to drive the loudspeaker, separate leads may be wired to each voice coil to allow the user to make an independent determination whether to wire the voice coils to the amplifier in series or in parallel.

While numerous designs exist for dual-coil, dual gap drivers, a continuing need exist to design high-power, cost effective dual-coil dual gap transducers. A need further exists for a dual-coil, dual magnetic gap transducer design that not only allows for large excursions without extreme distortion, but that also reduces some of the common problems that occur with a loudspeaker, including, but not limited to, the generation of resistive heat within a loudspeaker.

SUMMARY

According to one implementation, a dual-coil, dual magnetic gap electromagnetic transducer is provided where each voice coil is wired to include separate leads so that each individual voice coil may be driven by a separate amplifier or by a separate bridged amplifier. In either case, two lower power amplifiers or two lower power bridged amplifiers (totaling four amplifiers) may be utilized as opposed to one high-power amplifier or one high-power bridged amplifier. The use of two lower power amplifiers or two lower power bridged amplifiers as opposed to one high-power or one high-power bridged amplifier may result in a more cost effective loudspeaker design. For example, a more cost effective loudspeaker design may be especially realized in the case of powered loudspeakers where the amplifiers are built into the loudspeakers.

According to yet another implementation, signal processing may be utilized to drive the current through the separate amplifiers wired to the voice coils in the dual-coil, dual magnetic gap electromagnetic transducer. Utilizing signal processing, including but not limited to analog or digital signal processing, the power of the loudspeaker may be increased, extreme excursion may be achieved without extreme distortion and alternative voice coil configurations may be utilized to address common problems with dual-coil, dual magnetic gap transducers, including, but not limited to, heat generation. In one example, signal processing may be utilized to commutate the voice coils and achieve extreme excursion without significant distortion.

Other devices, apparatus, systems methods features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

FIGS. 1-16 describe various implementations of the present subject matter. For purposes of this application, in general, the term "communicate" (for example, a first component "communicates with" or "is in communication with" a second component) is used in the present disclosure to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

Figure 1:
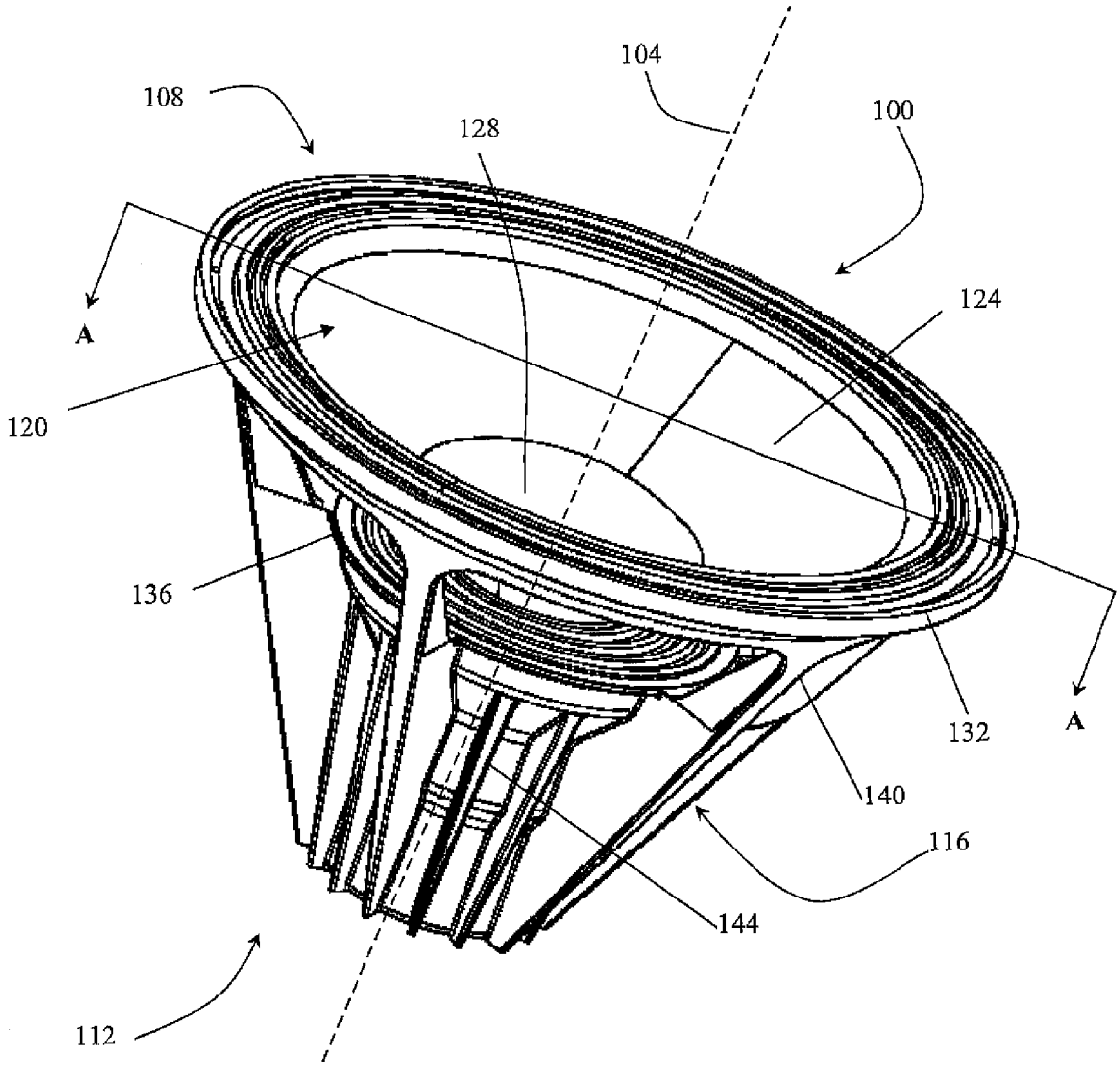
FIG. 1 is a top perspective view of an example of a loudspeaker of the invention.

Turning now to FIG. 1, FIG. 1 is a perspective view of an example of an electro-acoustical transducer in which one or more implementations of the invention may be provided. By way of example, the electro-acoustical transducer may be provided as a loudspeaker 100 or as part of the loudspeaker 100, although in other examples the electro-acoustical transducer is not limited to loudspeaker-type implementations. For purposes of description, the loudspeaker 100 may be considered as being generally arranged or disposed about a central, longitudinal axis 104. It will be understood, however, that the loudspeaker 100 is not limited to being completely symmetrical relative to such central axis 104. Also for purposes of description, the loudspeaker 100 and its components and features generally have a front or upper side 108 and a rear or lower side 112. It will be understood, however, that the use in this disclosure of terms such as "front," "upper," "rear" and "lower" is not intended to limit the loudspeaker 100 or any of its components and features to any particular orientation in space.

The loudspeaker 100 may include a housing 116. The housing 116 may be composed of any suitably stiff, anti-vibrational material such as, for example, a metal (e.g., aluminum, etc.). The utilization of aluminum or other thermally conductive material also enables the housing 116 to serve as a heat sink for the internal heat-generating components of the loudspeaker 100. The outer periphery of the housing 116 is generally swept about the central axis, such that the housing 116 may be considered as circumscribing or surrounding an interior space in which various components of the loudspeaker 100 are disposed. A housing 116 of this type may be referred to as a basket. Insofar as the housing 116 may constitute a combination of structural members and openings between structural members, the housing 116 may be considered at least partially enclosing this interior space. The space external to the housing 116, and more generally external to the loudspeaker 100, will be referred to as the ambient environment. In other implementations, the housing 116 may be continuous so as to completely enclose the interior space in which the components of the loudspeaker 100 are disposed, but openings are considered useful for allowing air to flow to and from the confines of the housing 116 and thus assisting in cooling the loudspeaker 100.

The loudspeaker 100 may also include a diaphragm 120 that spans the open front end of the housing 116. The diaphragm 120 may be any device that may be attached to or suspended by the housing 116 or other portion of the loudspeaker 100 in a manner that secures the diaphragm 120 while permitting at least a portion of the diaphragm 120 to move axially—i.e., along the direction of the central axis 104—in a reciprocating or oscillating manner. In the present example, the diaphragm 120 includes a generally cone-shaped member 124 (cone) that serves as an axially movable member, and a generally dome-shaped member 128 (dome) that may serve as a dust cover as well as an axially movable member. In other implementations, the movable portion of the diaphragm 120 may have a configuration other than conical, such as a dome or an annular ring. The cone 124 and dome 128 may be constructed from any suitably stiff, well-damped material such as paper. The cone 124 and dome 128 may be provided as a unitary or single-piece construction, or may be attached, connected, or adhered to each other by any suitable means. The cone 124 is attached to the housing 116 through one or more suspension members such as a surround 132 and a spider 136, either or both of which may be annular. The surround 132 and spider 136 may be affixed to the housing 116 by any suitable means. The surround 132 and spider 136 may be any devices that provide a mechanical interconnection between the diaphragm 120 and the housing 116, and allow the diaphragm 120 to move axially relative to the housing 116 while supporting the position of the diaphragm 120 radially relative to the housing 116. For this purpose, the surround 132 and spider 136 may be constructed from flexible, fatigue-resistant materials such as, for example, urethane foam, butyl rubber, phenolic-impregnated cloth, etc. In the illustrated example, the surround 132 and spider 136 have corrugated or "half-roll" profiles to enhance their flexibility and compliance. The surround 132 and spider 136 may be considered with the cone 124 and dome 128 as being parts of the assembly of the diaphragm 120, or may be considered as being components distinct from the diaphragm 120.

In the example illustrated in FIG. 1, the housing 116 generally includes an upper frame portion 140 and a lower frame portion 144. The upper frame portion 140 surrounds the diaphragm 120. The lower frame portion 144 surrounds several internal components of the loudspeaker 100, including an electromagnetic transducer or driver described in detail below.

Figure 2:
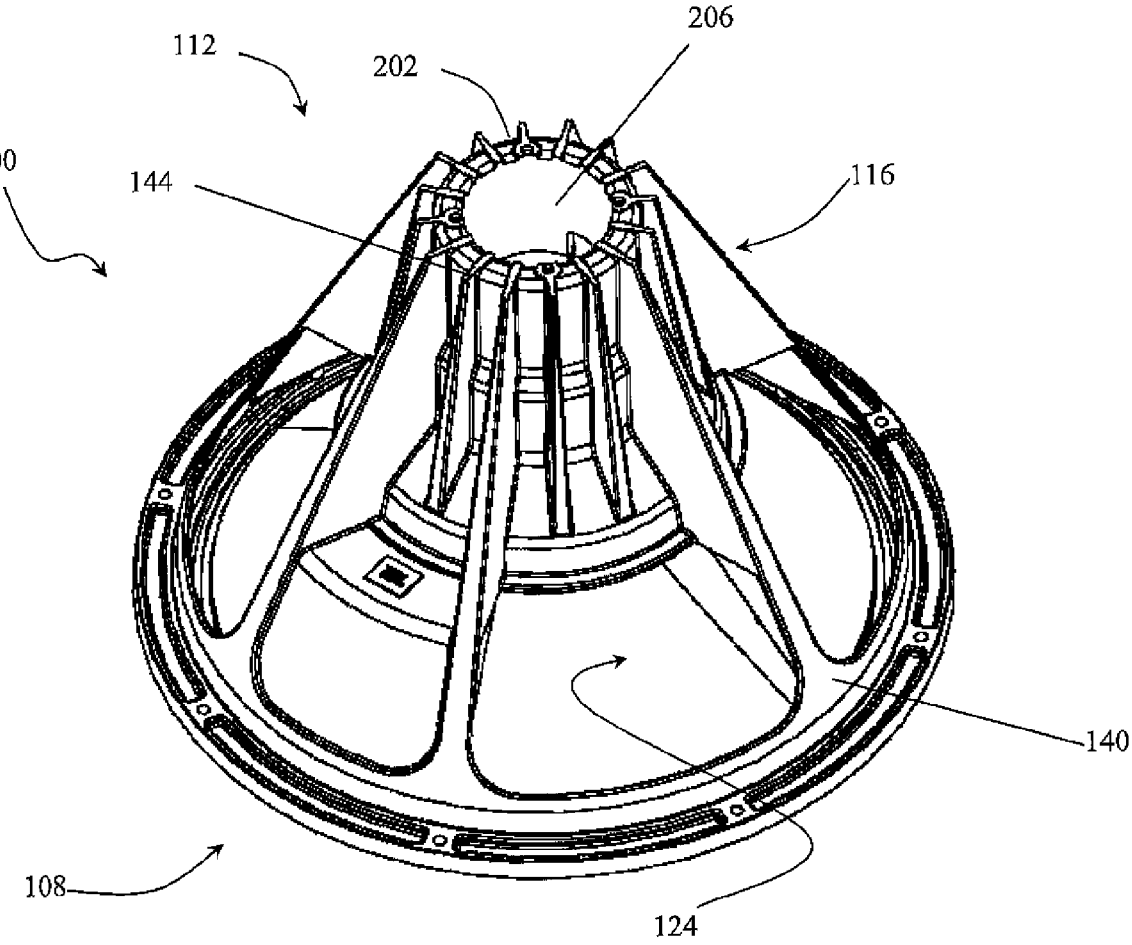
FIG. 2 is a bottom perspective view of the loudspeaker illustrated in FIG. 1.

FIG. 2 is rear perspective view of the loudspeaker 100 illustrated in FIG. 1. From this perspective, it can be seen that the lower frame portion 144 is bent or folded inwardly at a rear-most end 202 of the housing 116, and transitions to an inverted cup-shaped end frame portion or pedestal 206. The end frame portion 206 is described further below.

As a general matter, the loudspeaker 100 may be operated in any suitable listening environment such as, for example, the room of a home, a theater, or a large indoor or outdoor arena. Moreover, the loudspeaker 100 may be sized to process any desired range of the audio frequency band, such as the high-frequency range (generally 2 kHz-20 kHz) typically produced by tweeters, the midrange (generally 200 Hz-5 kHz) typically produced by midrange drivers, and the low-frequency range (generally 20 Hz-200 Hz) typically produced by woofers. In the examples provided in this description, the loudspeaker 100 may be considered as being of the direct-radiating type. However, in other alternative examples, the loudspeaker 100 may be considered as being of the compression driver type, the configuration of which is readily appreciated by persons skilled in the art.

Figure 3:
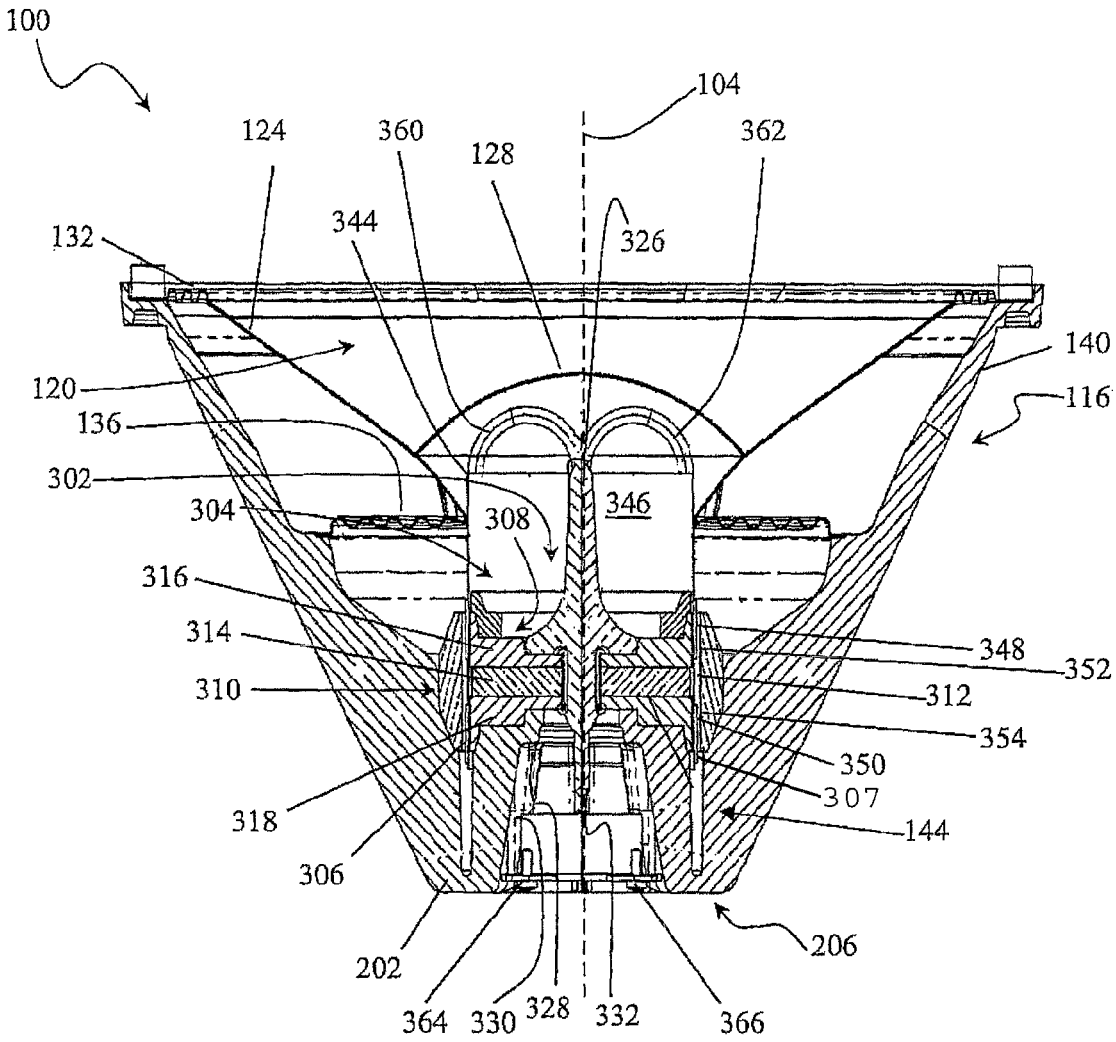
FIG. 3 is a cross-sectional view of the loudspeaker illustrated in FIGS. 1 and 2, taken along line A-A, according to one example of an implementation of the invention.

FIG. 3 is a cross-sectional view of the loudspeaker 100 illustrated in FIGS. 1 and 2 according to an example of one implementation of the invention. The cross-sectional view of FIG. 3 is taken along line A-A of FIG. 1. In this example, the loudspeaker 100 may be considered as having a "dual-coil drivers" or "dual-coil motor" configuration or, more generally, a multiple-coil configuration. As illustrated in FIG. 3, an electromagnetic driver or motor 302 is generally disposed in the lower frame portion 144 of the housing 116. The driver 302 includes a magnetic assembly 304 and an electrically conductive coil 306 (e.g., voice coil). The magnetic assembly 304 may be any device suitable for providing a permanent magnetic field with which the coil 306 may be electro-dynamically coupled. In the illustrated example, the magnetic assembly 304 includes an inner magnetic portion 308 and an outer magnetic portion 310. Generally, the terms "inner" and "outer" in this context refer to the radial positions of the two magnetic portions 308 and 310 relative to the central axis 104 and to each other. The outer magnetic portion 310 is generally coaxially disposed about the central axis 104 and may be in the form of a ring or annulus. The outer magnetic portion 310 may be referred to as, or considered as including, a gap sleeve or outer ring. The outer magnetic portion 310 is radially spaced from the inner magnetic portion 308 such that the inner magnetic portion 308 and outer magnetic portion 310 cooperatively define an annular air gap 312 (or magnetic gap) between these two components. In operation, the gap 312 is immersed in the permanent magnetic field established by the magnetic assembly 304. The inner magnetic portion 308 may include a stacked arrangement of ferromagnetic components that may have any suitable configuration such as plates, disks, or the like. In the illustrated example, the inner magnetic portion 308 includes a magnetic element 314 (magnet) interposed between a first (upper or front) pole piece 316 and a second (lower or rear) pole piece 318. The magnet 314 may be composed of any permanent magnetic material such as, for example, a ceramic, alnico, or a magnetic rare earth metal, particularly neodymium-iron-boron (Nd—Fe—B). The pole pieces 316 and 318 may be composed of any material capable of carrying magnetic flux such as, for example, steel, cast iron, etc.

In some implementations, one or more outer surface sections of the inner magnetic portion 308, such as the outer surfaces of the pole pieces 316 and 318 and/or the inner surface of the outer magnetic portion 310, may be covered with a sheathing, coating, or plating (not shown) composed of an electrically conductive material such as, for example, copper (Cu), aluminum (Al), or the like. Such sheathing may be employed to reduce distortion and inductance in the loudspeaker 100. In one example, the sheathing has a thickness ranging from about 0.015 to 0.150 inch.

The magnetic assembly 304 may be secured within the housing 116 by any suitable means. In the example illustrated in FIG. 3, the outer magnetic portion 310 abuts an inside surface of the lower frame portion 144. The lower or rear side of the inner magnetic portion 308 abuts another inside surface of the lower frame portion 144 and the upper or front side of the inner magnetic portion 308 abuts a centrally located support member 326. More specifically in this example, the end frame portion or pedestal 206 of the housing 116 includes a base section 328 and a sidewall section 330 interconnecting the base section 328 at the rear-most end 202. The base section 328 provides the inside surface to which the inner magnetic portion 308 abuts. This configuration provides large areas of surface contact between the outer magnetic portion 310 and the housing 116, and between the inner magnetic portion 308 and the housing 116, thus providing enhanced heat transfer from the magnetic assembly 304 to the housing 116. Moreover, the dimensions of the lower frame portion 144 and end frame portion 206 relative to the coil 306 and magnetic assembly 304, and the contiguous relation between the lower frame portion 144 and the end frame portion 206, result in a large, continuous solid mass that serves well as a heat sink yet is relatively compact in design.

As also illustrated in the example of FIG. 3, the base section 328 has a central bore 332 that is aligned with respective central bores of the components of inner magnetic portion 308. By this configuration, the position of the inner magnetic portion 308 may be fixed by inserting the centrally located support member 326 through the respective central bores of the inner magnetic portion 308 and into the central bore 332 of the base section 328. The centrally located support member 326 may include threads that mate with threads within the central bore 332 of the base section 328, or the centrally located support member 326 may be coupled or attached to the base section 328 by any other suitable means.

The coil 306, which may be referred to as a voice coil, may generally be any component that oscillates in response to electrical current while being subjected to the magnetic field established by the magnetic assembly 304. In the illustrated example, the coil 306 is constructed from an elongated conductive element such as a wire that is wound about the central axis 104 in a generally cylindrical or helical manner. The coil 306 is mechanically referenced to, or communicates with, the diaphragm 120 by any suitable means that enables the oscillating coil 306 to consequently actuate or drive the diaphragm 120 in an oscillating manner, thus producing mechanical sound energy correlating to the electrical signals transmitted through the coil 306. In the illustrated example, the coil 306 mechanically communicates with the diaphragm 120 through a coil support structure or member such as a coil former 344. The coil former 344 may be cylindrical as illustrated by example in FIG. 3, and may be composed of a stiff, thermally resistant material such as, for example, a suitable plastic (e.g., polyamide, etc.). The coil former 344 also functions to support the coil 306. The diameter of the coil former 344 is greater than the outside diameter of the inner magnetic portion 308 and less than the inside diameter of the outer magnetic portion 310, enabling the coil former 344 in practice to extend into, and be free to move axially through, the gap 312 between the inner magnetic portion 308 and outer magnetic portion 310. At least a portion of the coil 306 is wound or wrapped on the outer surface of coil former 344 and may be securely attached to the coil former 344 such as by an adhesive. The coil 306 may be positioned on the coil former 344 such that at any given time during operation of the loudspeaker 100, at least a portion of the coil 306 is disposed in the gap 312. With this configuration, in operation the coil former 344 oscillates with the coil 306 and the oscillations are translated to the diaphragm 120.

The magnetic assembly 304 is axially spaced from the diaphragm 120. The portion of the interior space of the loudspeaker 100 that generally separates the magnetic assembly 304 from the diaphragm 120 along the axial direction will be referred to as a medial interior region 346. In the present example in which the coil former 344 is connected to the diaphragm 120 in the manner illustrated in FIG. 3, the coil 306 is likewise separated from the diaphragm 120 by the medial interior region 346.

As previously noted, the loudspeaker 100 may be considered as having "dual-coil drive" or "dual-coil motor" configuration. This configuration may be realized in the example illustrated in FIG. 3 forming the coil 306 so as to include a plurality of distinct coils, such that the coil 306 in effect constitutes a plurality of individual coils. In the present example, the wire of the coil 306 is wound around the coil former 344 for a desired number of turns to form a first or upper voice coil 348. A separate wire 307 is then is wound around the coil former 344 for a desired number of turns to form a second voice coil 350 that is axially spaced from the first voice coil 348. Other designs may be utilized that include additional distinct voice coils.

The first coil 348 and the second coil 350 may be positioned on the coil former 344 such that at any given time during operation of the loudspeaker 100, at least a portion of the first coil 348 and at least a portion of the second coil 350 are disposed in the gap 312. Moreover, the first coil 348 may be positioned such that it is generally aligned with (i.e., adjacent to) the first pole piece 316, and the second coil 350 may be positioned such that it is generally aligned with (i.e., adjacent to) the second pole piece 318. By this configuration, the gap 312 may be considered as including an upper gap 352 in which the first coil 348 extends between the first pole piece 316 and the outer magnetic portion 310, and a lower gap 354 in which the second coil 350 extends between the second pole piece 318 and the outer magnetic portion 310.

In a case where the first coil 348 has the same number of turns (windings) as the second coil 350, the number of turns is doubled in comparison to a single-coil configuration having the same number of turns of either individual coil 348 or 350. In addition, the surface area covered by the coil 306 having two coils 348 and 350 is also doubled. The wire forming the coil 306 may be run in a clockwise direction in one of the coils 348 or 350 and in a counterclockwise direction in the other coil 350 or 348. By this configuration, the electrical current runs through one of the coils 348 or 350 in a direction opposite to the electrical current running through the other coil 350 or 348. Because the magnetic flux lines established by the magnetic assembly 304 run in opposite directions in each of the first gap 352 and second gap 354 and the current in each coil 348 and 350 runs in opposite directions, Lorenz law holds that the force created by the current in each coil 348 and 350 runs in the same direction, thus doubling the force imparted to the coil former 344 and enabling the loudspeaker 100 to generate more power in comparison to a single-coil loudspeaker.

Generally, in operation, the loudspeaker 100 receives an input of electrical signals at an appropriate connection to the coil 306, and converts the electrical signals into acoustic signals. The acoustic signals propagate or radiate from the vibrating diaphragm 120 to the ambient environment. In addition, the vibrating diaphragm 120 establishes air flow in the interior space of the loudspeaker 100, including in the medial interior region 346 between the diaphragm 120 and the magnetic assembly 304 and coil 306.

In this example, each voice coil 348 and 350 has a pair of wires 360 and 362 connected to the coils 348 and 350, respectively. The wires 360 and 362 extend upward and away from the voice coils 348 and 350 and are fed through the central bore 332 of the driver 302 to terminals 364 and 366. In operation, the terminals 364 and 366 will each be connected to a separate amplifier channel to separately power each voice coil 348 and 350. In this regard, two lower power amplifiers may be utilized to power the loudspeaker driver.

Figure 4:
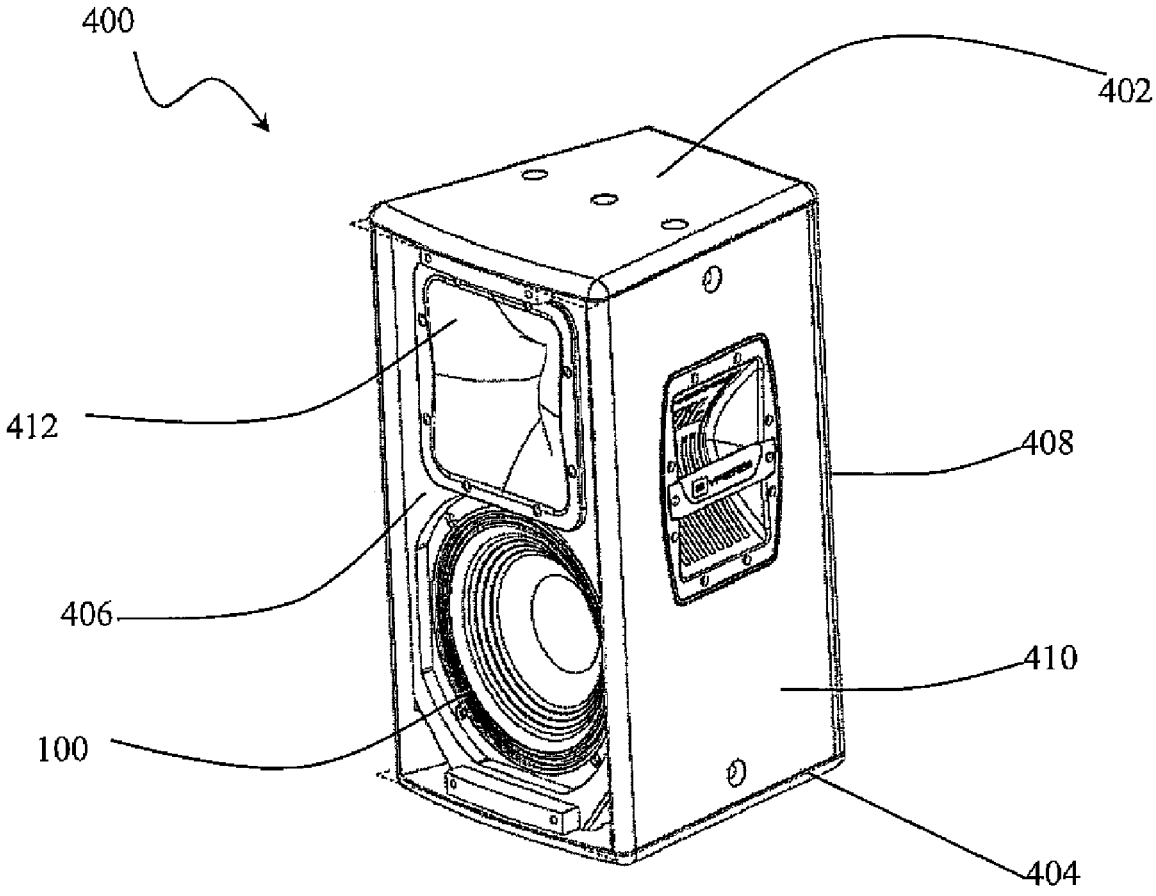
FIG. 4 is a perspective view of an example of a powered loudspeaker of the invention.

FIG. 4 is a perspective view of an example of a powered loudspeaker of the invention. Unlike stand alone loudspeakers, the powered loudspeaker 400 is encased in a housing that includes the loudspeaker driver 100 as well as an amplification module (see FIGS. 6 & 7 below), which may include a signal processor (see also FIGS. 6 & 7). Accordingly, a powered loudspeaker 400 does not need to be connected separately to an amplifier or a receiver to operate. The amplification of the loudspeaker 400 is built into the powered loudspeaker 400.

As illustrated in FIG. 4, the powered loudspeaker 400 is encased in a housing that includes a top 402, bottom 404 and two sides 410. The loudspeaker 400 of FIG. 4 also includes a back panel 408 and a front face 406. Aligned in the front face 406 of the powered loudspeaker 400 is a horn 412 and a loudspeaker driver 100.

Figure 5:
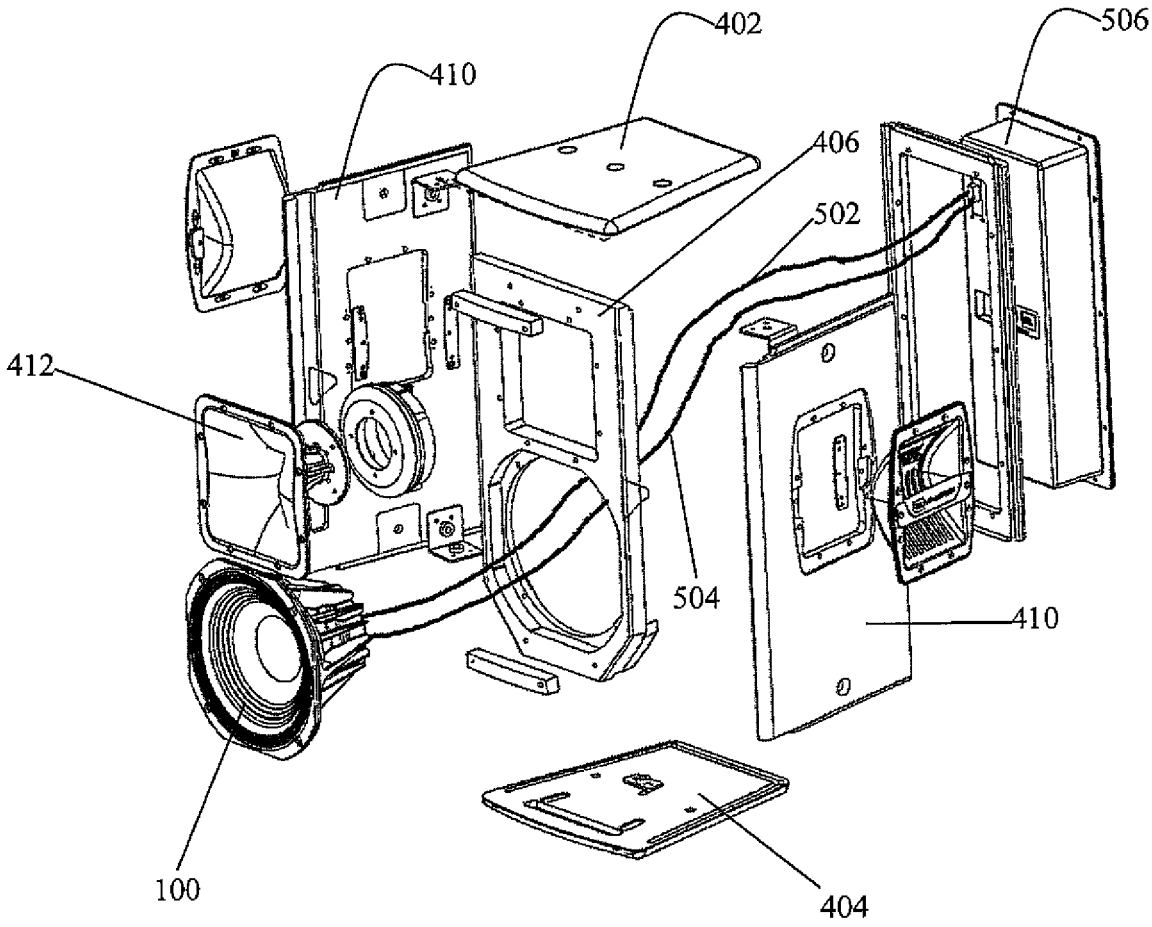
FIG. 5 is an exploded perspective view of the powered loudspeaker of FIG. 4

FIG. 5 is an exploded perspective view of the powered loudspeaker 400 of FIG. 4. As illustrated in FIG. 5, the powered loudspeaker 400 includes many different structural components. In this illustration, it can be seen that the powered loudspeaker 400 has a top 402, bottom 404, front face 406 and two side panels 410. Aligned in the front face 406 of the powered loudspeaker 400 is a horn 412 and a loudspeaker 100 that includes a dual-coil, dual gap magnetic driver. Two pairs of wires 502 and 504 are connected to the loudspeaker 100. Each pair of wires 502 and 504 is connected to one voice coil 348 and 350, respectively. These dual pair of wires 502 and 504 then allow for connection, either directly or through connection via terminals on the loudspeaker driver 100, to an amplifier module 506.

Figure 6:
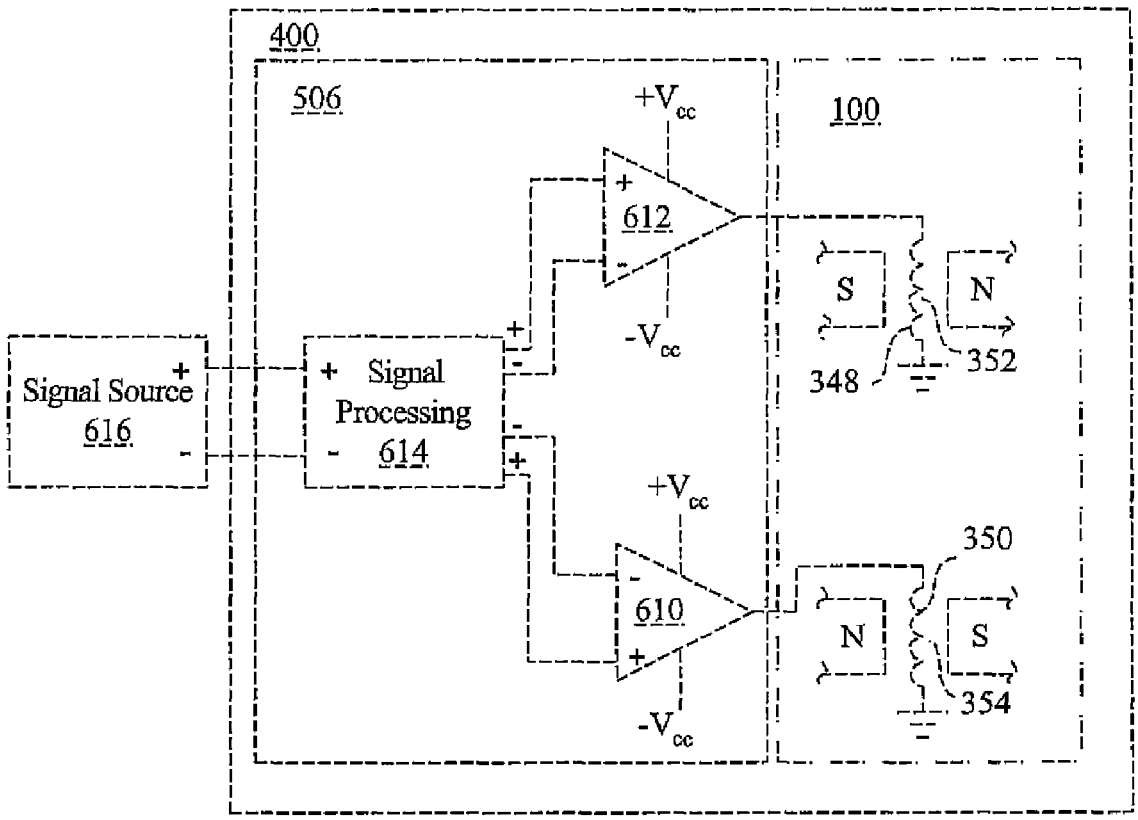
FIG. 6 is a schematic diagram of a loudspeaker system illustrating a dual-coil, dual gap transducer having separate amplifiers connected to each voice coil.

FIG. 6 is a schematic diagram of one embodiment of one example of a powered loudspeaker 400 illustrating a dual-coil, dual gap transducer having separate amplifiers 612 and 610 connected to each voice coil 348 and 350. As illustrated in FIG. 6, the loudspeaker 400 includes a loudspeaker driver 100 having dual-coils 348 and 350 positioned within dual magnetic gaps 352 and 354. Also included within the powered loudspeaker 400 is an amplifier module 506 that includes a first amplifier 610 and a second amplifier 612 connected directly to a signal processing module 614 for processing audio signals received from a signal source 616.

Figure 7:
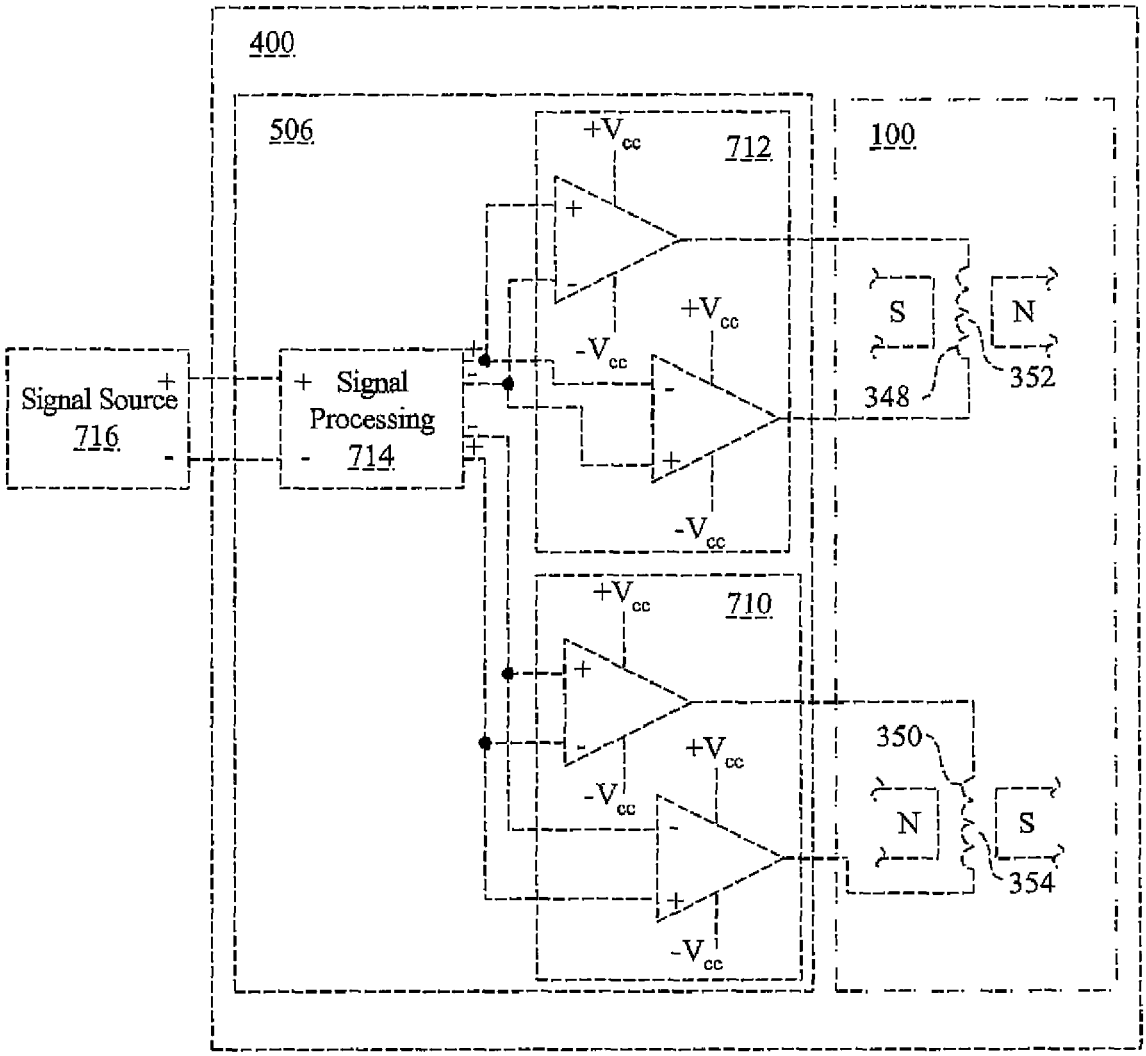
FIG. 7 is a schematic diagram of another example of a loudspeaker system illustrating a dual-coil, dual gap transducer having separate bridged amplifiers connected to each voice coil.

FIG. 7 is a schematic diagram of another example of one embodiment of a powered loudspeaker 400 illustrating a dual-coil, dual gap transducer having separate bridged amplifiers 710 and 712 connected to each voice coil 348 and 350. As illustrated in FIG. 7, the loudspeaker 400 also includes a loudspeaker driver 100 having dual voice coils 348 and 350 each positioned within a magnetic gap 352 and 354. Each voice coil 348 and 350 is then connected to a bridged amplifier 712 and 710, respectively, the form part of the amplifier module 506. The bridged amps 710 and 712 are then connected to a signal processing module 714 for processing the audio signals received from a signal source 716 external the powered loudspeaker 400.

In another example of an embodiment, signal processing may be utilized to drive the electrical current through the voice coils. Various types of signal processing may be utilized, including but not limited to analog or digital signal processing. By utilizing signal processing, the voice coils may be driven independently and powered differently over time addressing common problems with dual-coil, dual gap loudspeakers that may be improved upon which will increase the overall output and linearity of dual-coil, dual-gap loudspeaker drivers. For example, the maximum output of the loudspeaker may be increased by utilizing signal processing to independently drive the voice coils. Further, extreme excursion may be achieved without extreme distortion. Additionally, alternative voice coil configurations may be utilized to address common problems with dual-coil, dual magnetic gap transducers, including, but not limited to, heat generation. Those skilled in the art will recognize that optimization of the loudspeaker may be achieved in a variety of way using signal processing to independently drive the voice coils in a dual-coil, dual-gap loudspeaker drivers utilizing separate amplifiers for different voice coils.

In one example, as illustrated in FIGS. 8-16 below, signal processing, such as digital signal processing, may be utilized to commutate the voice coils 348 and 350 so that extreme excursion may be achieved without extreme distortion or over heating. As further explained below, in this regard, each voice coil 348 and 350 will be delivered a different signal to optimize current flow so that each voice coil 348 and 350 can move through the magnetic gaps 352 and 354 in a linear fashion, which minimizes distortion.

FIGS. 8-16 illustrate the movement of the voice coils from resting positioning through extreme excursion utilizing signal processing to independently drive the voice coils through separate amplifiers. In this example, as will be further explained below, power may be provided to the voice coils through the separate amplifiers at different times to commutate the voice coils 348 and 350, thereby achieving extreme excursion with minimal distortion. FIGS. 8-16 are all cut away views of a portion of the loudspeaker 100 in FIG. 3 showing the right side of the driver 302. FIGS. 8-16 depict the outer magnetic portion 310 and an inner magnetic portion 308 that includes a magnet element 314 interposed between a first pole piece 316 and second pole piece 318. The general orientation of the flux lines 800 of the electrostatic field between the inner magnetic portion 308 and outer magnetic portion 310 are also illustrated in FIGS. 8-16. The flux lines 800 are intangible lines that are illustrated to demonstrate the directional flow of the magnetic flux in the loudspeaker 100 to complete the static magnetic circuit.

Figure 8:
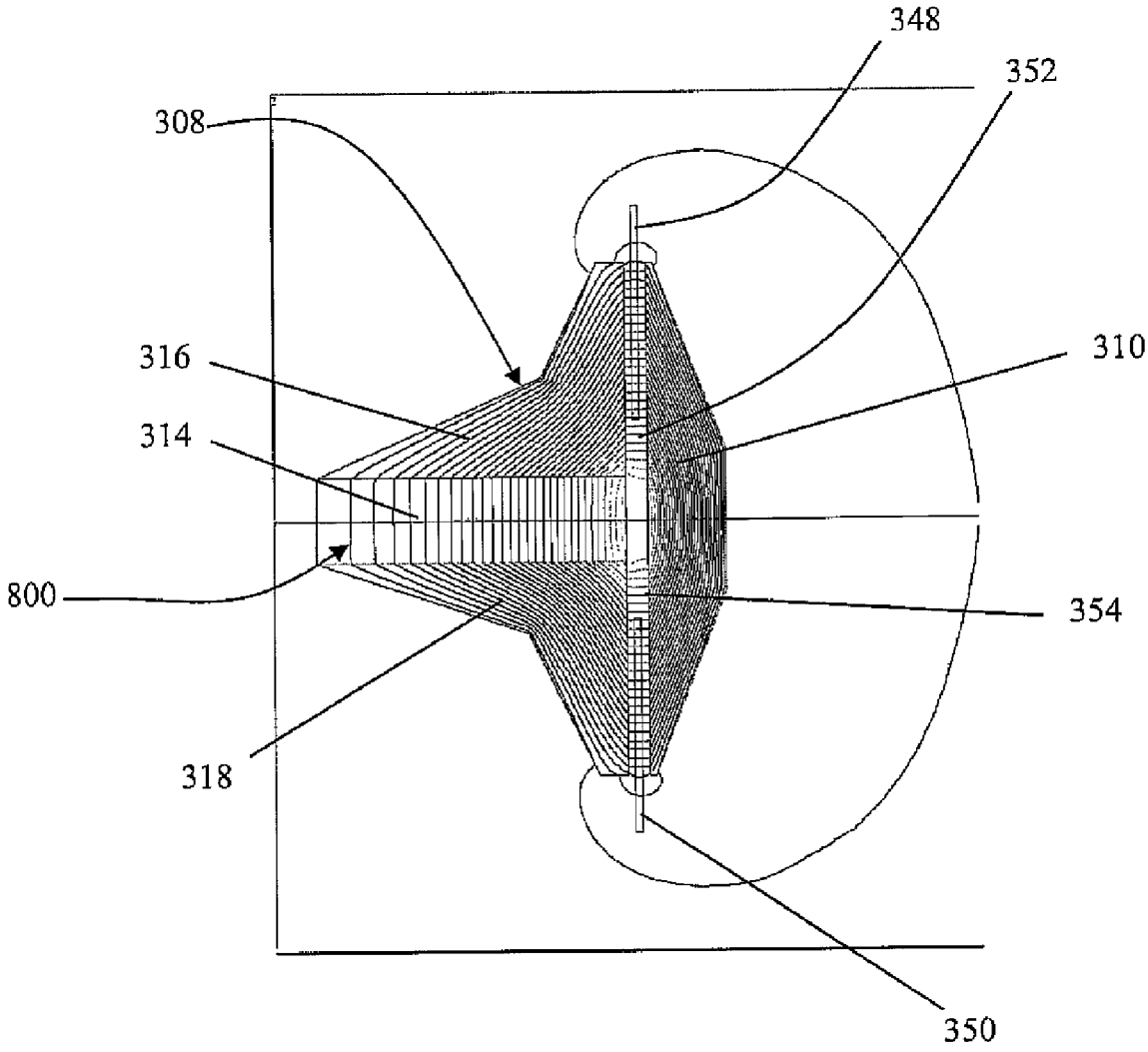
FIG. 8 is cut away view of a portion of the loudspeaker in FIG. 3 as the voice coils would appear in their resting position.

FIG. 8 is cut away view of a portion of the loudspeaker in FIG. 3 as the voice coils 348 and 350 would appear in their resting position. As illustrated in FIG. 8, in a typical dual voice coil design, the voice coils 348 and 350, when in their resting position, are not centered in each magnetic gap 352 and 354. Everything is, however, symmetrical about the driver motor 302.

Figure 9:
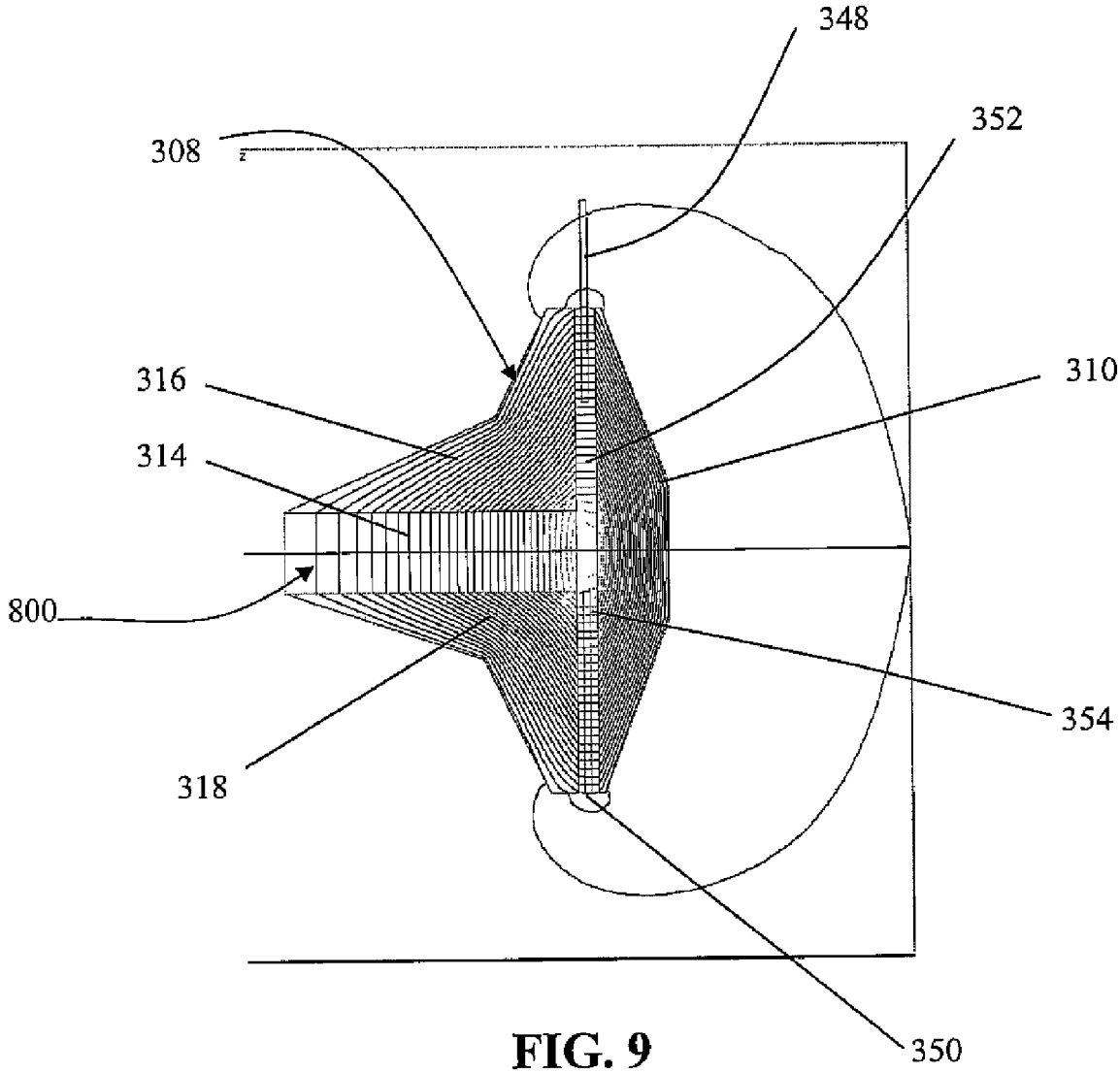
FIG. 9 illustrates the voice coils of the loudspeaker of FIG. 6 as the voice coils would appear moving upward as the upper voice coil begins to leave the upper magnetic gap.

FIG. 9 illustrates the voice coils 348 and 350 of the loudspeaker motor 302 of FIG. 8 as the voice coils 348 and 350 would appear moving upward to dive the diaphragm of the loudspeaker 100. As the voice coils 348 and 350 move upward, the lower coil 350 moves more fully into the lower magnetic gap 354 raising the effective magnetic coupling and force on the voice coil 350. As illustrated, the upper voice coil 348 is leaving the upper magnetic gap 352 and the effective coupling is going down. The result is that the summed force from the two voice coils 348 and 350 is relatively constant moving from resting position to this position and would be considered a linear movement. Within this limit of excursion, driving the coils differently may not be desirable, depending upon the application.

Figure 10:
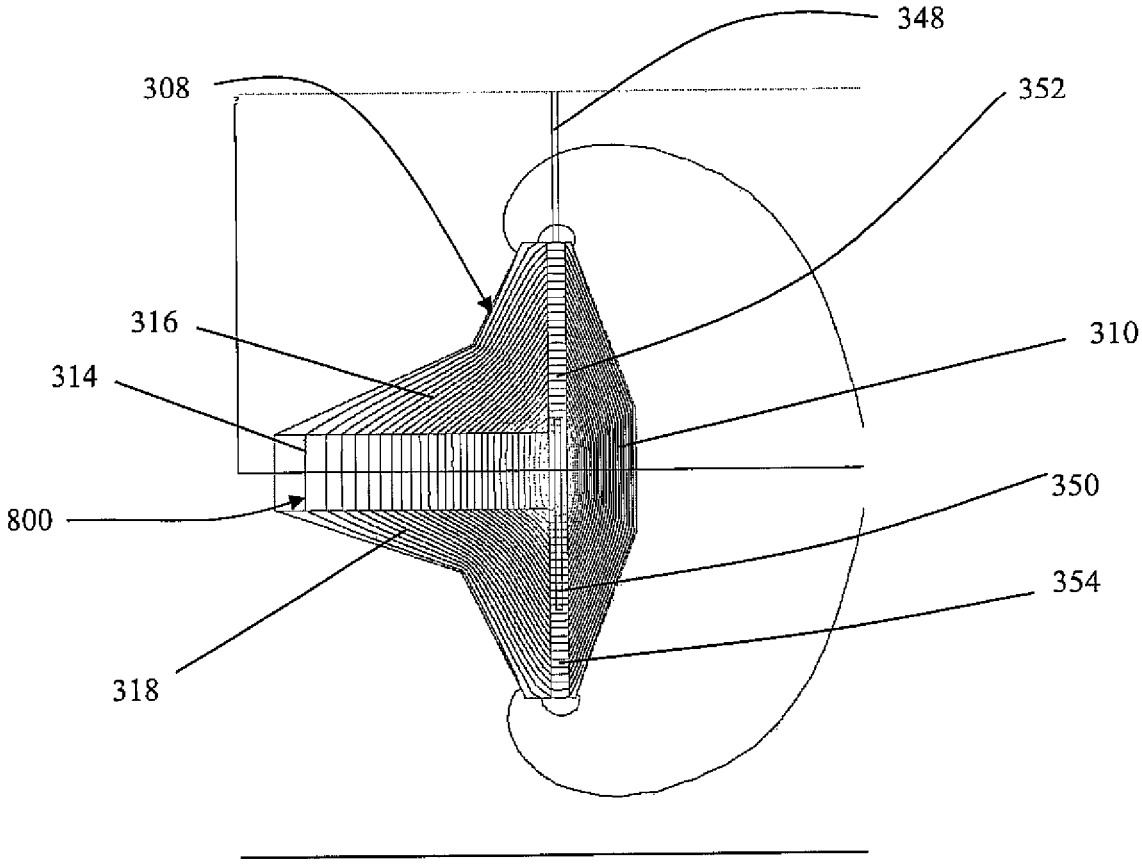
FIG. 10 illustrates the voice coils of the loudspeaker of FIG. 6 as the voice coils would appear as the upper coil leaves the upper magnetic gap.

FIG. 10 illustrates the voice coils 348 and 350 of the loudspeaker of FIG. 8 as the voice coils 348 and 350 would appear as the upper voice coil 348 starts to leave the upper gap 352. Generally, as the upper voice coil 348 starts to leave the upper gap 352, the force that the upper voice coil 348 generates begins to disappear and the driver begins to 'runs out of gas'. Absent the use of the signal processing to independently drive the voice coils 348 and 350, this level of excursion is the practical limit for the standard dual-coil, dual gap loudspeaker driver. If, however, the two coils 348 and 350 were driven separately, by different amplifiers, using signal processing, the upper coil 348 could be shut off at this stage to keep it from burning up. The lower coil 350 could then have increased current momentarily applied to it as it starts to leave the lower gap 354 in order to maintain constant force which, absent the additional application of current, would quickly reduce the force of the lower voice coil 350.

Figure 11:
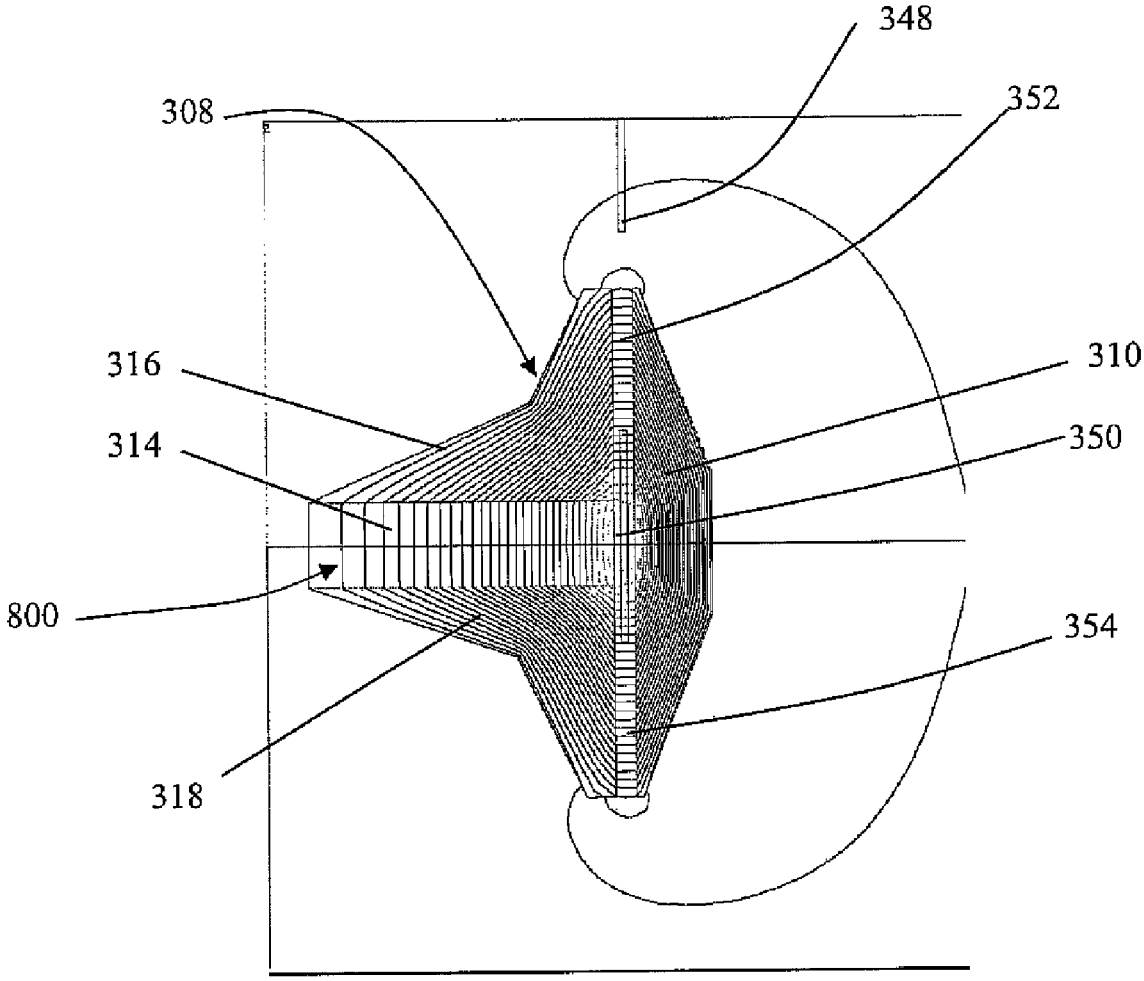
FIG. 11 illustrates the voice coils of the loudspeaker of FIG. 6 as the voice coils would appear when the lower coil is in the center of both fields, i.e., at the zero crossing.

FIG. 11 illustrates the voice coils 348 and 350 of the loudspeaker motor 302 of FIG. 8 as the voice coils 348 and 350 would appear when the lower coil 350 is in the center of both fields. In this position, the lower coil 350 is now in the center of both fields, which are opposite in direction, and thus, the net force on the coil is zero regardless of the current. At this point, the current would be shut off for the lower voice coil 350 to avoid overpowering.

Figure 12:
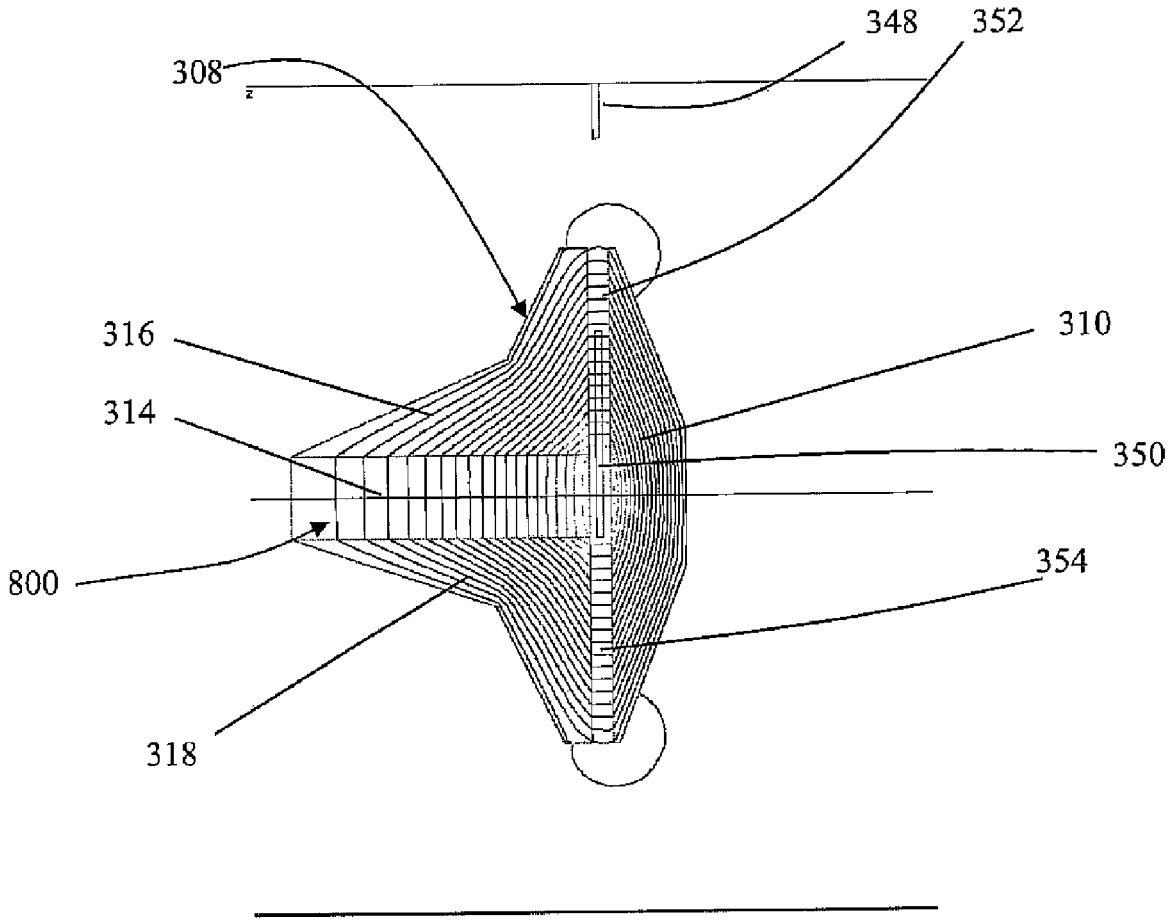
FIG. 12 illustrates the voice coils of the loudspeaker of FIG. 6 as the voice coils would appear after the lower coil passes through the zero crossing and into the upper gap.

FIG. 12 illustrates the voice coils 348 and 350 of the loudspeaker motor 302 of FIG. 8 as the voice coils would appear after the lower voice coil 350 passes through the zero crossing (FIG. 11) and into the upper gap 352. As the lower voice 350 coil passes through this 'zero crossing', the direction of current to the lower voice coil 350 should then flip so that it can use the upper field to continue to push the lower voice coil 350 upward. During this movement, power to the upper voice coil 348 continues to be off.

Figure 13:
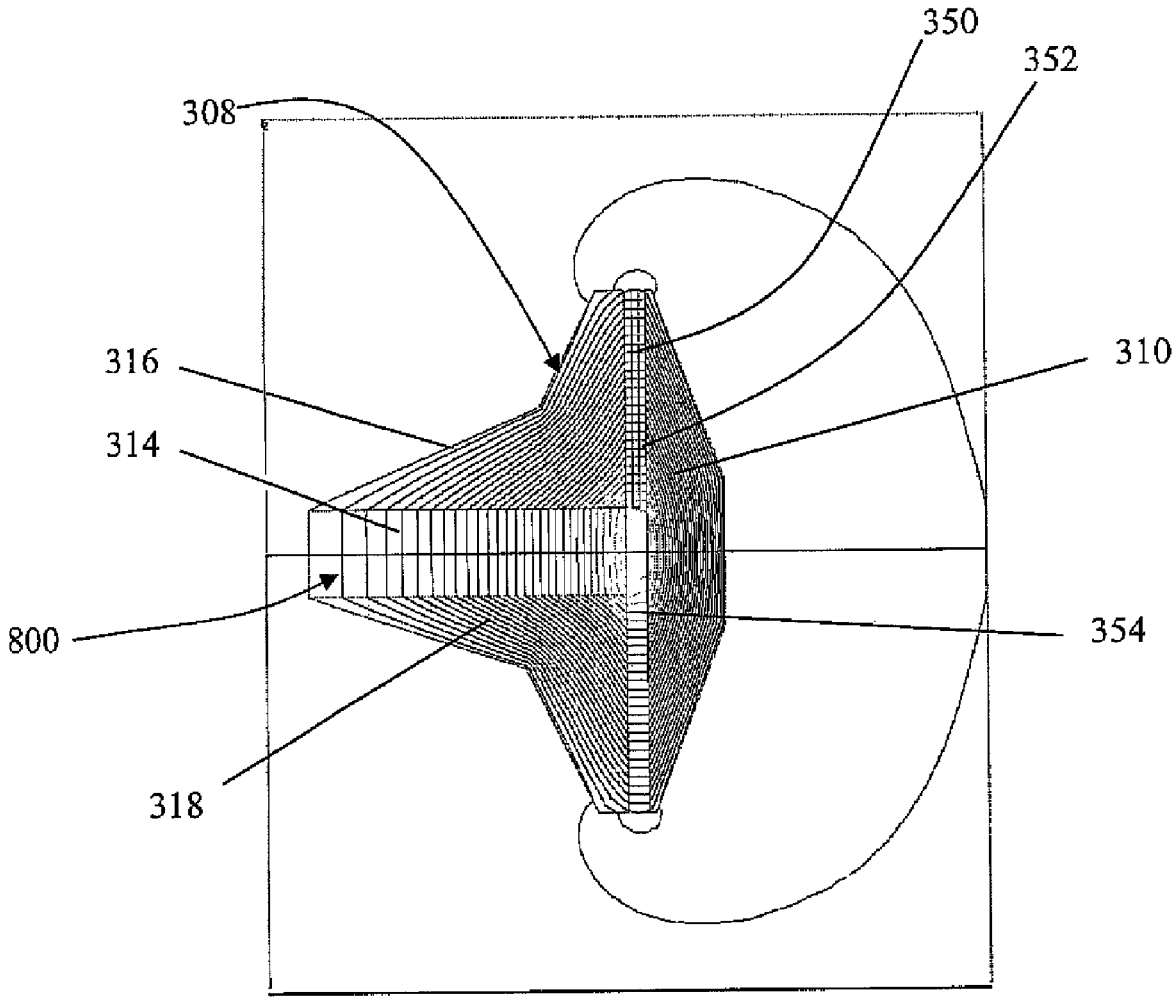
FIG. 13 illustrates the voice coils of the loudspeaker of FIG. 6 as the voice coils would appear when the lower coil is fully in the upper gap.

FIG. 13 illustrates the voice coils 348 and 350 of the loudspeaker motor 302 of FIG. 8 as the voice coils 348 and 350 would appear when the lower coil 350 is fully in the upper gap 352. When the lower voice coil 350 is fully in the upper gap 352 (and the phase is flipped, as described in connection with FIG. 12 above), the lower voice coil 350 is able to provide good coupling to the upper gap 352 and continue excursion.

Figure 14:
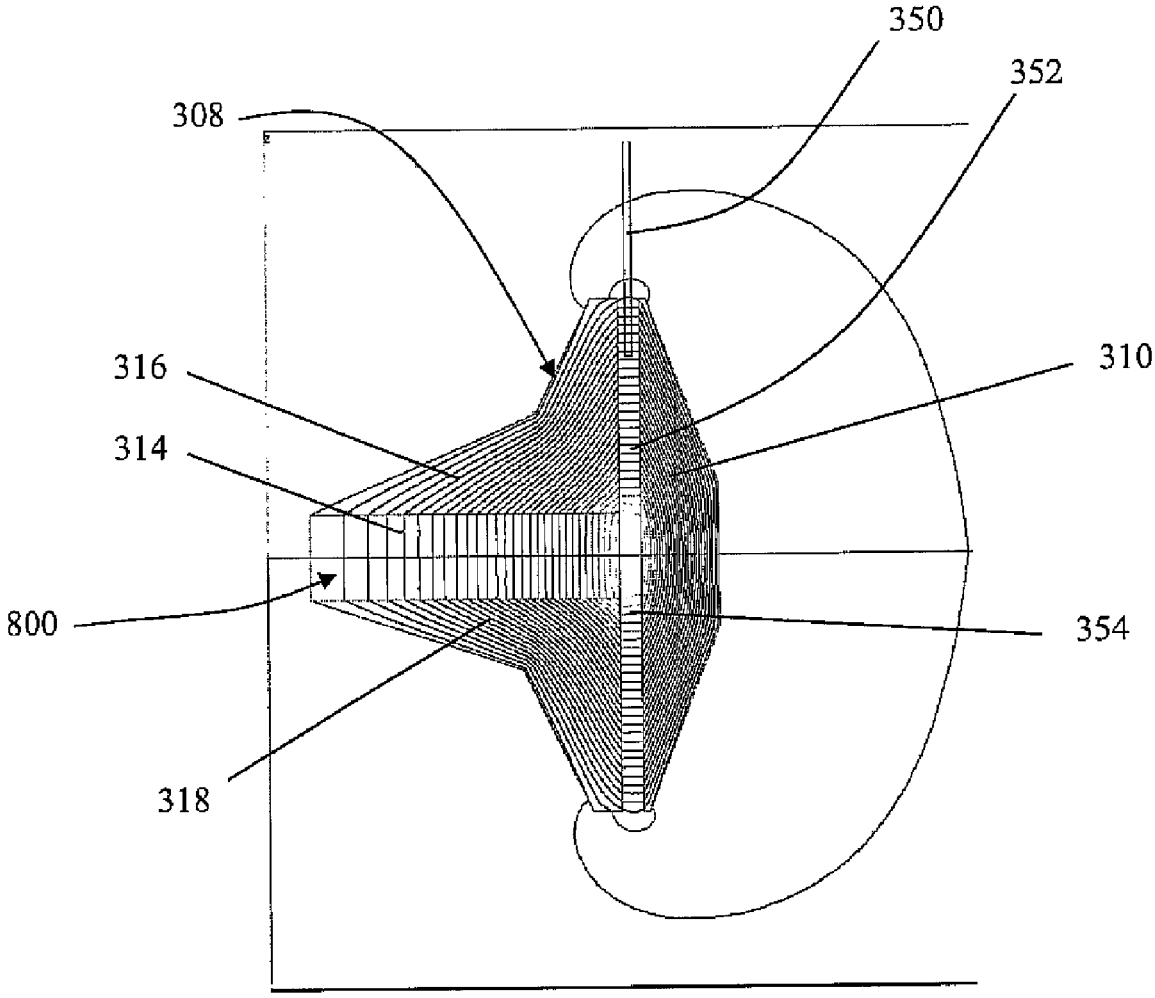
FIG. 14 illustrates the voice coils of the loudspeaker of FIG. 6 as the voice coils would appear when the lower coil leaves the upper gap.

FIG. 14 illustrates the voice coils 348 and 350 of the loudspeaker motor 302 of FIG. 8 the voice coils 348 and 350 would appear when the lower voice coil 350 leaves the upper magnetic gap 352. As the lower voice coil 350 leaves the upper magnetic gap 352, the lower voice coil 350 now 'runs out of gas' as it no longer has a magnetic field to couple to. The resulting excursion from this example results in an excursion that is more than twice the length of one of the voice coils 348 and 350.

As the voice coils 348 and 350 return to their resting position, the currents of the voice coil 348 and 350 are opposite to what moved the voice coils 348 and 350 to the extreme position. More particularly, to move the voice coils 348 and 350 back to the resting position (downward), the reverse scenario will take place. The lower coil 350 is the only coil operating pulling it back into the upper gap and flipping polarity as is passes through the zero crossing after which the upper coil 348 is turned back on as it enters the upper gap. In this manner, one voice coil 350 will bear most of the load in one direction to achieve the extreme portion of the excursion and return it to the rest position. The burden then switches to the other voice coil 348 when moving downward below the rest position, which allows the voice coil 350 that just did the 'heavy lifting' to cool off. An algorithm that applies this phased application of current to each of the voice coils 348 and 350 may be thought of as electronically commutating a linear motor.

Figure 15:
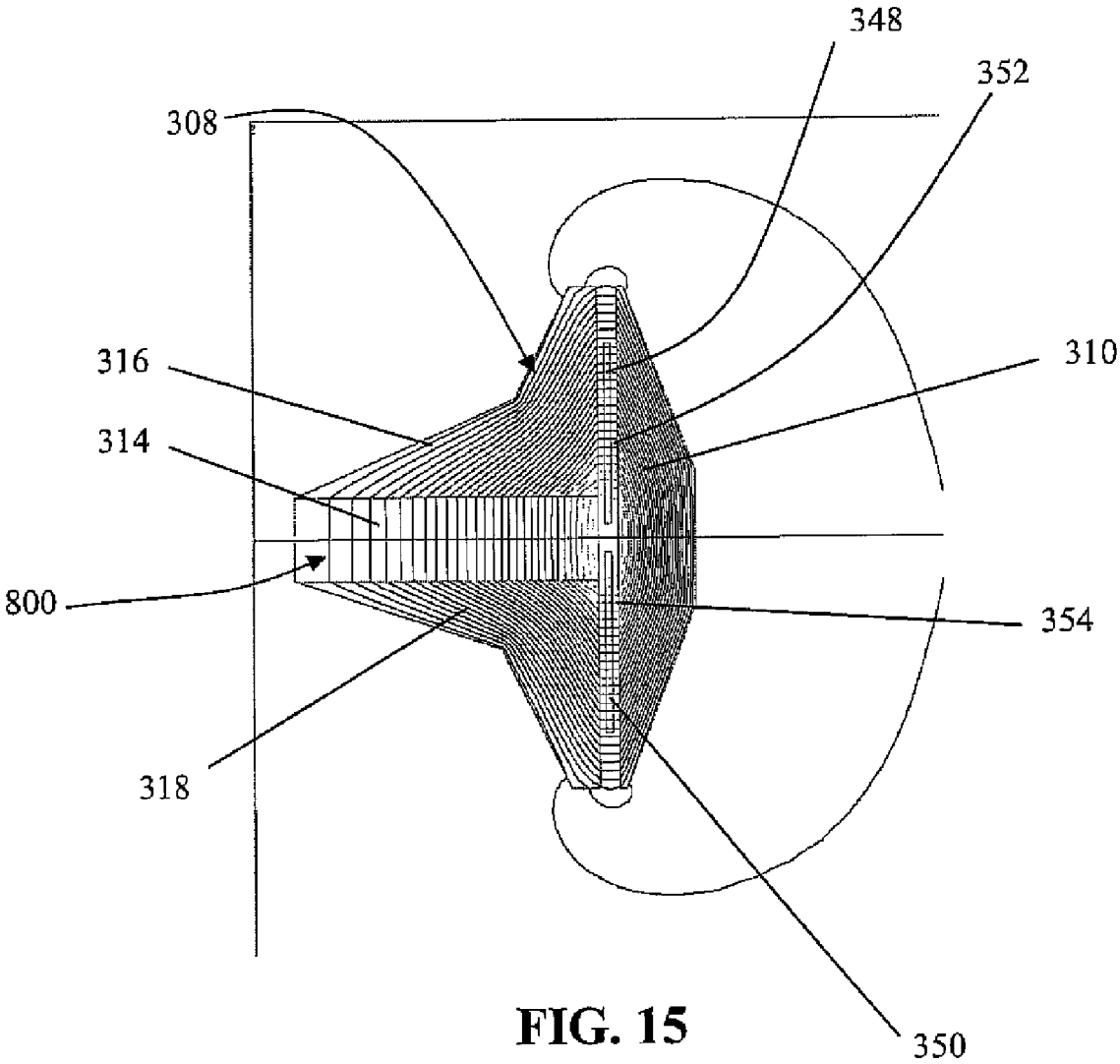
FIG. 15 is a cut away view of a portion of the loudspeaker in FIG. 5 where the voice coils are in an alternative resting configuration as they are positioned closer to one another in the first and second gaps than the coils of the loudspeaker illustrated in FIG. 3.

FIG. 15 is a cut away view of a portion of the loudspeaker motor 302 in FIG. 3 in which the voice coils 348 and 350 are in an alternative resting configuration. In this example of an embodiment, the voice coils 348 and 350 are positioned closer to one another in the first and second magnetic gaps 352 and 354 than the voice coils 348 and 350 of the loudspeaker illustrated in FIG. 8. In particular, FIG. 15 illustrates all under-hung dual voice coil configuration. In this configuration, the voice coils 348 and 350 will easily move into the other gap 352 and 354 in high excursion. If, however, we have drive intelligence, utilizing signal processing, to predict when the voice coils 348 and 350 will move into the other gap 352 and 354, the signal processing can make the appropriate adjustments, by independently powering the voice coils 348 and 350 at varying times. In this manner, the loudspeaker 100 will work better than if the voice coils 348 and 350 are spaced farther apart. The advance of this placement can be seen in FIG. 16.

Figure 16:
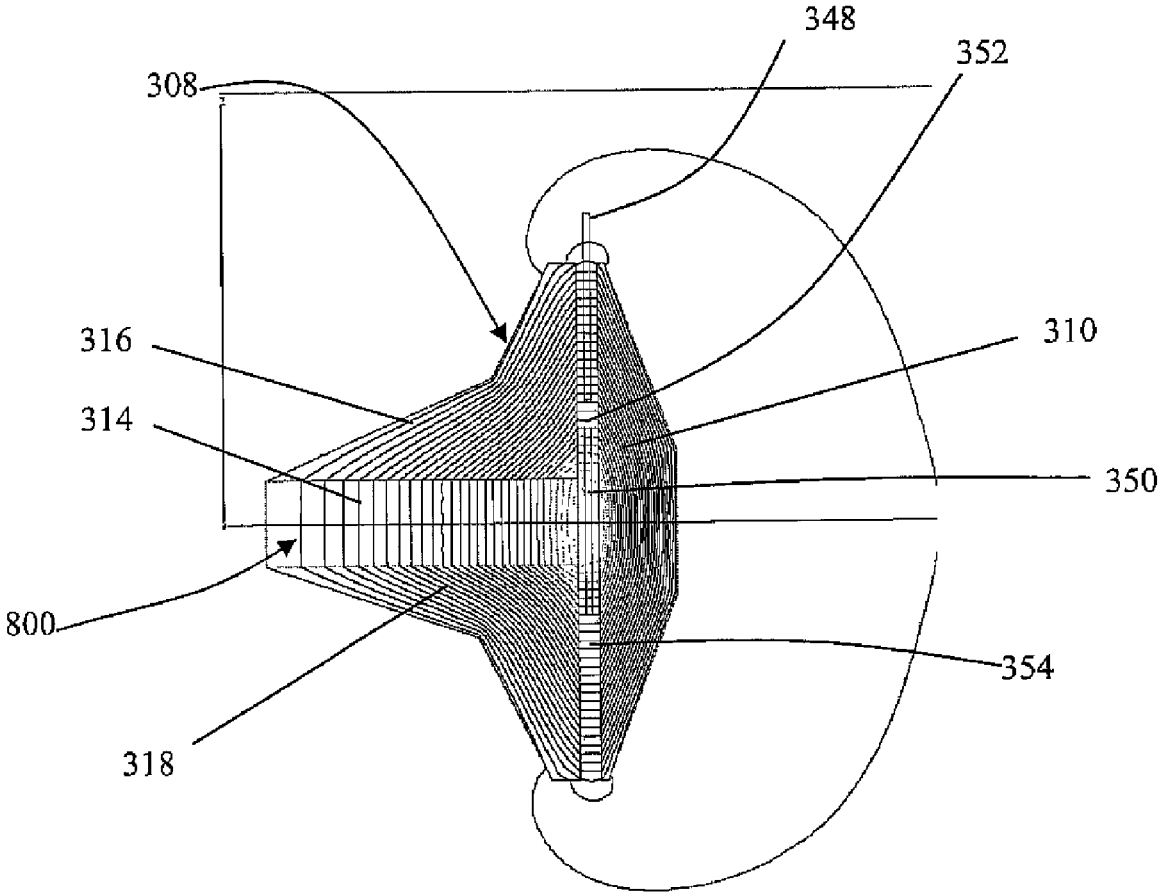
FIG. 16 illustrates the voice coils of FIG. 13 as the voice coils would appear moving upward where the lower coil is positioned in a zero crossing position and the upper coil is still in the upper magnetic gap.

FIG. 16 illustrates the voice coils 348 and 350 of FIG. 15 as the voice coils 348 and 350 would appear moving upward where the lower voice coil 350 is positioned in a zero crossing position. In this position, when the lower voice coil 350 is at the 'zero crossing', the upper voice coil 348 is still well within the upper magnetic gap 352. By having the voice coils 348 and 350 positioned closer together, it provides for a much smoother transition as the lower voice coil 350 must have current that goes to zero as it flips phase through the excursion. In the example illustrated in FIG. 8-14, there may likely be 'switching distortion' as the lower driver coil 350 passes through the zero crossing. Further, this configuration may also better address concerns with heat transfer.

While the specific examples illustrated in FIG. 3-16 provide two coils 348 and 350 and two corresponding gaps 352 and 354, it will be understood that other implementations may provide more than two coils 348 and 350 and two corresponding gaps 352 and 354. When more than two voice coils are utilized, more than two amplifiers may accordingly be utilized to power the voice coils. When utilizing more than two voice coils, it may be desirable to power each voice coil through a separate amplifier. Further, depending upon the application, it may be desirable to power only a few, but not all, of the voice coils separately, while powering the others together.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A loudspeaker comprising:

a housing disposed around a central axis;

a diaphragm including a flexible diaphragm portion reciprocatively movable relative to the central axis;

a magnetic assembly disposed in the housing and axially spaced from the diaphragm by an interior region of the housing, the magnetic assembly having at least a first magnetic gap and a second magnetic gap annularly disposed about the central axis;

an electrically conductive coil mechanically communicating with the diaphragm, the electrically conductive coil including at least a first voice coil and a second voice coil axially spaced from each other where the first voice coil is at least partially disposed in the first magnetic gap and the second voice coil is at least partially disposed in the second magnetic gap;

a first amplifier in communication with the first voice coil;

a second amplifier in communication with the second voice coil wherein the first amplifier and the second amplifier are separate amplifiers rather than bridged relative to each other; and a signal processor to provide an input to the first amplifier different from an input provided to the second amplifier to cause independent movement of the first voice coil relative to the second voice coil.

2. The loudspeaker of claim 1, where the first amplifier is a bridged amplifier with a pair of amplifiers.

3. The loudspeaker of claim 2, where second amplifier is a bridged amplifier with a pair of amplifiers separate from the first amplifier.

4. The loudspeaker of claim 1, where the second amplifier is a bridged amplifier with a pair of amplifiers.

5. The loudspeaker of claim 1 wherein the signal processor is selectively used to alternately provide power to the first voice coil or the second voice coil in order to extend an excursion of the first and second voice coils.

6. The loudspeaker of claim 5 where the signal processor uses digital signal processing.

7. The loudspeaker of claim 5 where the signal processor uses analog signal processing.

8. The loudspeaker of claim 5 where the signal processing to control the power delivered to by the first and second amplifiers to the respective first voice coil and second voice coil is able to commutate at least one of the first and second voice coils.

9. The loudspeaker of claim 1 where first voice coil is completely disposed in the first magnetic gap and the second voice coil is completed disposed in a second magnetic gap when the first and second voice coils are in their resting positions.

10. A loudspeaker comprising:

a housing disposed around a central axis;

a diaphragm including a flexible diaphragm portion reciprocatively movable relative to the central axis;

a magnetic assembly disposed in the housing and axially spaced from the diaphragm by an interior region of the housing, the magnetic assembly having at least a first and second magnetic gap annularly disposed about the central axis;

an electrically conductive coil mechanically communicating with the diaphragm, the electrically conductive coil including at least a first voice coil and a second voice coil axially spaced from each other where the first voice coil is at least partially disposed in the first magnetic gap and the second voice coil is at least partially disposed in the second magnetic gap;

a first bridged amplifier with a pair of amplifiers in communication with the first voice coil;

a second bridged amplifier with a pair of amplifiers separate from the first bridged amplifier in communication with the second voice coil; and a signal processor to provide an input to the first amplifier different from an input provided to the second amplifier to cause independent movement of the first voice coil relative to the second voice coil.

11. The loudspeaker of claim 10 where the signal processor is selectively used to provide power to one of the first voice coil or the second voice coil while simultaneously not providing power to the other voice coil.

12. The loudspeaker of claim 10 where the signal processor uses digital signal processing.

13. The loudspeaker of claim 10 where the signal processor uses analog signal processing.

14. The loudspeaker of claim 10 where the signal processor is able to commutate the first voice coils to provide movement of the first voice coil into the second magnetic gap.

15. The loudspeaker of claim 10 where the first voice coil is positioned completely disposed within the first magnetic gap in the resting position and the second voice coil is positioned completely disposed within the second magnetic gap in the resting position.

16. A loudspeaker comprising:

a housing disposed around a central axis;

a diaphragm including a flexible diaphragm portion reciprocatively movable relative to the central axis;

a magnetic assembly disposed in the housing and axially spaced from the diaphragm by an interior region of the housing, the magnetic assembly having at least a first and second magnetic gap annularly disposed about the central axis;

an electrically conductive coil mechanically communicating with the diaphragm, the coil including at least a first voice coil and a second voice coil axially spaced from each other where the first voice coil is at least partially disposed in the first magnetic gap and the second voice coil is at least partially disposed in the second magnetic gap;

a first pair of wires in communication with the first voice coil for connection to a first amplifier;

a second pair of wires in communication with the second voice coil for connection to a second amplifier which is separate from the first amplifier rather than bridged with the first amplifier; and a signal processor to provide an input to the first amplifier different from an input provided to the second amplifier to cause movement of the first voice coil relative to the second voice coil.

17. A method for powering a loudspeaker, the method comprising:

providing a transducer with a magnetic assembly in which an annular gap is formed, a coil including at least a first voice coil and a second voice coil axially spaced from each other where the first voice coil is at least partially disposed in a first magnetic gap and the second voice coil is at least partially disposed in a second magnetic gap;

passing signals from a signal source to a signal processor;

passing a first set of electrical signals from the signal processor to a first amplifier;

passing a second set of electrical signals from the signal processor to a second amplifier;

passing electrical signals from the first amplifier through the first voice coil passing electrical signals from the second amplifier separate from the first amplifier and not bridged with the first amplifier through the second voice coil; and wherein at least a portion of the first set of electrical signals differs from a corresponding portion of the second set of electrical signals to allow the first voice coil to be driven independently of the second voice coil.

18. The method of claim 17 where the electrical signal from the first amplifier is generated by a bridged amplifier having a pair of amplifiers.

19. The method of claim 17 where the electrical signal from the second amplifier is generated by a bridged amplifier having a pair of amplifiers.

20. The method of claim 17 further including a step of altering the electrical signals from the first amplifier to the first voice coil to reduce current provided to the first voice coil when the first voice coil is positioned in both the first magnetic gap and second magnetic gap such that a net force is zero from a field associated with the first magnetic gap and a field associated with the second magnetic gap.

21. The method of claim 20 further including the utilizing the signal processor to commutate the first and second voice coils as they move through the magnetic gaps.

22. The method of claim 17 further including a step of altering the electrical signals from the second amplifier to the second voice coil to reduce current provided to the second voice coil when the second voice coil is positioned in both the first magnetic gap and second magnetic gap such that a net force is zero from a field associated with the first magnetic gap and a field associated with the second magnetic gap.

23. A loudspeaker comprising:

a housing disposed around a central axis;

a diaphragm including a flexible diaphragm portion reciprocatively movable relative to the central axis;

a magnetic assembly disposed in the housing and axially spaced from the diaphragm by an interior region of the housing, the magnetic assembly having an inner magnetic portion comprising at least one magnet interposed between at least two pole pieces, and an outer magnetic portion, where the inner magnetic portion and the outer magnetic portion define at least a first and second magnetic gap annularly disposed about the central axis;

an electrically conductive coil mechanically communicating with the diaphragm, the coil including at least a first voice coil and a second voice coil axially spaced from each other where the first voice coil is at least partially disposed in the first magnetic gap and the second voice coil is at least partially disposed in the second magnetic gap;

a first pair of wires in communication with the first voice coil for connection to a first amplifier;

a second pair of wires in communication with the second voice coil for connection to a second amplifier which is separate from the first amplifier rather than bridged with the first amplifier; and a signal processor to provide an input to the first amplifier different from an input provided to the second amplifier to cause movement of the first voice coil relative to the second voice coil.

* * * * *